US007128848B2

(12) United States Patent
Pourdeyhimi et al.

(10) Patent No.: US 7,128,848 B2
(45) Date of Patent: Oct. 31, 2006

(54) PHOTOLUMINESCENT FIBERS AND FABRICS WITH HIGH LUMINANCE AND ENHANCED MECHANICAL PROPERTIES

(75) Inventors: Behnam Pourdeyhimi, Cary, NC (US); Trevor J. Little, Cary, NC (US)

(73) Assignee: North Carolina State University, Raleigh, NC (US)

( * ) Notice: Subject to any disclaimer, the term of this patent is extended or adjusted under 35 U.S.C. 154(b) by 262 days.

(21) Appl. No.: 10/180,809

(22) Filed: Jun. 26, 2002

(65) Prior Publication Data

US 2003/0122107 A1 Jul. 3, 2003

Related U.S. Application Data

(60) Provisional application No. 60/301,718, filed on Jun. 28, 2001.

(51) Int. Cl.
*C09K 11/02* (2006.01)
*D03D 15/00* (2006.01)
*D04B 7/00* (2006.01)

(52) U.S. Cl. ..... 252/301.36; 442/199; 442/311; 442/361

(58) Field of Classification Search ..... 428/690, 428/373, 374, 375; 429/917; 252/301.16, 252/40, 301.36; 313/504, 506; 442/199, 442/311

See application file for complete search history.

(56) References Cited

U.S. PATENT DOCUMENTS 4,781,647 A * 11/1988 Doane, Jr. ..... 446/219
5,109,463 A * 4/1992 Lee ..... 385/123
5,338,037 A * 8/1994 Toyohara ..... 473/268
5,674,437 A * 10/1997 Geisel ..... 264/21
5,914,076 A 6/1999 Schloss
5,959,402 A * 9/1999 Polyan ..... 313/511
6,001,491 A * 12/1999 Bayer et al. ..... 428/500
6,162,539 A * 12/2000 Shimizu et al. ..... 428/373
6,307,207 B1 * 10/2001 Burbank ..... 250/462.1

FOREIGN PATENT DOCUMENTS

JP 2000-096349 * 4/2000
JP 2000-136438 * 5/2000

* cited by examiner

*Primary Examiner*—Rena Dye
*Assistant Examiner*—Camie S. Thompson
(74) *Attorney, Agent, or Firm*—Jenkins, Wilson, Taylor & Hunt, P.A.

(57) ABSTRACT

A photoluminescent thermoplastic multi-component fiber comprising a pigmented component and processing enhanced luminescence and mechanical properties. Most suitably, the pigmented component comprises between 5% and 30% by weight of photoluminescent pigment and the pigmented component is between 20% and 50% by weight of the multi-component fiber. The multi-component fiber can be formed from either POY or FDY, and the multi-component fiber can have many different cross section shapes including sheath/core. These single component or multi-component fibers can be made into a variety of fabrics. Additionally, single component or multi-component fibers can also be formed into single or multi-component melt-blown and spunbonded fabrics.

1 Claim, 7 Drawing Sheets

PHOTOLUMINESCENT FIBERS AND FABRICS WITH HIGH LUMINANCE AND ENHANCED MECHANICAL PROPERTIES

RELATED APPLICATIONS

The present application claims priority to the U.S. provisional patent application Ser. No. 60/301,718 filed Jun. 28, 2001 and titled "Photo Luminescent Fibers."

FIELD OF THE INVENTION

The present invention relates to photoluminescent fibers and fabrics, and more particularly to high luminance photoluminescent fibers and fabrics with good mechanical properties.

BACKGROUND ART

Luminescence is a phenomenon in which the electronic state of a substance is excited by an external energy source and emits this energy in the form of light when it returns to its grounded state. Photoluminescence is the one form of the luminescence in which the excitation energy source is incident light and it includes both fluorescence and phosphorescence. These two phenomena are fundamentally different and are substantially different with respect to their lifetime. For inorganic materials, light emission from a substance during the time when it is exposed to exciting radiation is called fluorescence, while after-glow if detectable by the human eye after the cessation of excitation is called phosphorescence. For organic molecules, light emission from a single excited state is called fluorescence, while that from a triplet excited state is defined as phosphorescence.

Phosphor, which is a solid luminescent material, has a wide range of applications classified as: (1) light sources represented by fluorescent lamps; (2) display devices represented by cathode-ray tubes; (3) detector systems represented by x-ray screens and scintilators; and (4) other simple applications, such as luminous paint with long persistent phosphorescence.

Most phosphors are composed of a transparent microcrystalline host (or a matrix) and an activator, i.e., a small amount of intentionally added impurity atoms distributed in the host crystal. Different combinations of host and activators give rise to different characteristics such as color, the degree of initial luminescence intensity, and luminescence decay properties.

Sulfide phosphorescent phosphors including CaS:Bi (violet blue), CaStS:Bi (blue), ZnS:Cu (green), and ZnCdS:Cu (yellow or orange) have been known nearly 100 years. However, (Ca, Sr) S:Bi phosphor (blue) shows extremely poor chemical stability of the host material as well as weak luminance and after glow characteristics. $CaSrS:Br^{3+}$ is produced by adding $Bi^{3+}$ to a mixture of $CaCO_3$, $SrCO_3$, and S and then heating to 1100° C. in normal atmosphere for 1.5 hours. However, it is rarely used as a phosphorescent medium since it decomposes readily when exposed to moisture. A red-emitting phosphor, ZnCdS:Cu is not practically used since Cd, which occupies almost a half of the host material is highly toxic. A green-emitting phosphor ZnS:Cu is the most widely used phosphor and is inexpensive. It is produced by adding Cu, $10^{-2}$wt % of the weight as the activator to ZnS, mixing with flux (NaCl, KCL, or $NH_4Cl$, etc.), and then heating to 1250° C. for 2 hours in a normal atmosphere. In addition to Cu, several parts per million (ppm) of Co may also be added. However, zinc sulfide phosphorescent phosphor is decomposed as the result of irradiation by ultraviolet radiation in the presence of moisture and thus blackens or reduces the luminance. Therefore, it is difficult to use this phosphorescent phosphor in fields where it is placed outdoors and exposed to a direct sunlight, thus limiting its application to luminous clocks/watches and instrument dials, excavation guiding signs or indoor night time displays. Normally, after-glow time is between about 30 minutes to 2 hours (see U.S. Pat. Nos. 5,424,006 and 5,951,915).

The relatively new categories of phosphor, alkaline earth metal type aluminate phosphor, overcome many shortcomings of the sulfide phosphors. One such example is the new phosphor $SrAl_2O4:Eu^{2+}$, $Dy^{3+}$ invented by Nemoto & Co. Ltd in 1993 see U.S. Pat. No. 5,424,006. This material is produced by mixing $Al_2O_3$ and $SrCO_3$, adding $Eu^{2+}$ and $Dy^{3+}$ as the activator and co-activator, respectively, and then heating it in a reducing atmosphere electric oven to 1300° C. for 3 hours. $SrAl_2O_4:Eu^{2+}$ emits a broadband green luminescence peaking at about 520 nm due to the 4f-5d transition of $Eu^{2+}$, and has long after-glow persistence. This alkaline earth metal-type aluminate activated by europium or the like is a novel phosphorescent phosphor completely different from conventional sulfide phosphorescent phosphors. Further, it was shown to be chemically stable and showed excellent photo-resistance due to an oxide. Adding $Dy^{3+}$ as the auxiliary activator dramatically increases the initial brightness.

The more general form of alkaline earth metal-type of aluminate phosphors is:

$$MA1_2O_4:Eu,(N)$$

wherein:

M=at least one metal element selected from calcium, strontium, barium

Eu: 0.001%–10% (an activator)

N: as a coactivator, 0.001–10%, at least one element selected from the group consisting of lanthanum, cerium, praseodymium, neodymium, samarium, gadolinium, dysprosium, holmium, erbium, thulium, ytterbium, lutetium, tin and bismuth.

Other types of Eu-activated phosphor have also been developed and show different luminescence color and properties. One example is a Eu-activated silicated phosphorescent phosphor (see U.S. Pat. No. 5,951,915).

The presently known long phosphorescent phosphors are listed in Table 1 below. In this table, the luminance values of the phosphors are reported for samples with a thickness of more than 200 mg/cm$^2$, measured 10 minutes after a 5-minute exposure to a 1000–1×($D_{65}$) light source (according to Japanese Industrial Standard, JIS Z 8720, Standard Illuminants and Source for Colorimetry), whose color temperature is 6500K. Persistent time refers to the time (in minutes) that it takes for the after-glow to decrease to a luminance of 0.3 mcd/m$^2$ representing the lower limit of light perception of the human eye.

TABLE 1

(Luminous Phosphors)

| Composition | Luminescence color | Luminescence wavelength at peak (nm) | After-glow brightness (after 10 min) (mcd/m$^2$) | After-glow persistence time (min) |
|---|---|---|---|---|
| $CaSrS:Br^{3+}$(Sr, 10–20%) | Blue | 450 | 5 | Semi-long (about 90) |
| $CaAl_2O_4:Eu^{2+}$, $Nd^{3+}$ | Blue | 440 | 35 | Long (over 1000) |
| ZnS:Cu | Yellow-Green | 530 | 45 | Semi-long (about 200) |
| ZnS:Cu, Co | Yellow-Green | 530 | 40 | Long (over 500) |
| $SrAl_2O_3:Eu^{2+}$ | Green | 520 | 30 | Long (over 2000) |
| $SrAl_2O_3:Eu^{2+}$, $Dy^{3+}$ | Green | 520 | 400 | Long (over 2000) |
| $CaS:Eu^{2+}$, $Tm^{3+}$ | Red | 650 | 1.2 | Short (about 45) |

Incorporating photoluminescent phosphor into textile structures provides major advantages in many uses, especially in safety applications. In the past, this photoluminescence effect has been especially useful for the marking of emergency pathways. Escape routes that are marked with photoluminescent products on the floor and at the lower part of the wall remain visible for many hours even in power failure situations. The desire to use this photoluminescent effect for protective clothing led to increasing interest in photoluminescence textile goods development. Athletic apparel, hunting gear, ropes and cords, life vests and even carpets for theaters and airplane interiors are a few examples. Other applications may include lingerie, and protective clothing markets for firefighters and chemical workers. However, incorporating phosphorescent pigment into textile structures to provide enough durability, luminescence intensity, and good after-glow properties without impairing the physical properties has been a unique challenge in producing photoluminescent textile goods.

Photoluminescent phosphors also have been applied to yarns by passing them through a bath containing a photoluminescent material and a binder (see U.S. Pat. Nos. 2,787,558 and 3,291,668). Such methods, however, may lead to increased stiffness of the yarn and fabrics, loss of textile-like properties and vulnerable to abrasion. Consequently, the properties of the textiles formed from such yarns are inadequate and the durability of their photoluminescence is normally poor.

To improve the photoluminescence of textile properties in yarns, direct spinning of photoluminescent homocomponent fibers has also been attempted. Photoluminescent polymers can be made by mixing and kneading of a thermoplastic polymer and photoluminescence phosphors (see U.S. Pat. No. 6,123,871) and this polymer can be subsequently extruded into fibers (see U.S. Pat. Nos. 5,674,437 and 5,914,076). Although, direct incorporation of the photoluminescence phosphors into fibers overcomes many of the difficulties with coating methods, many challenges remain. When a luminous fiber is prepared by a method which comprises kneading aluminous pigment directly into a fiber, the content of the luminous pigment is preferably 5% by weight or less. When the content exceeds 5% by weight, fiber-forming characteristics of the polymers tend to deteriorate. Consequently, the fibers will be more brittle, cannot be drawn easily to the same extent as the pure polymer and are significantly weaker than their pure polymer fibers. Further, over time, the moisture that can be present on the surface and the circumference of the fiber may react with the luminous pigment and cause discoloration and deterioration of the luminous performance. It has been revealed that such phenomena will shift gradually from the surface to the inside of the fiber with the luminous pigment exposed on the fiber surface acting as a trigger.

In prior art, bicomponent sheath/core fiber was used to enhance fiber-forming properties. A high luminance luminous fiber comprising a core component containing a polyolefin resin and a luminous pigment and a sheath component comprising a polyolefin resin containing no luminous pigment is the subject of U.S. Pat. No. 6,162,539. The luminescent material content and core/sheath ratio was shown to be critical for both luminescent properties and fiber forming properties. The patent discloses that the core component may contain up to 60% by weight of the luminous pigment. It has been reported, however, that when the core to sheath ratio was less than 1:3, section unevenness tended to develop in the core and that this tended to deteriorate fiber-forming properties. Similarly, when the core to sheath ratio exceeded 1:1, the fiber strength tended to decrease significantly.

The present invention is intended to overcome many of the well known deficiencies of prior art luminescent fibers and to provide a new and improved photoluminescent fiber.

SUMMARY OF THE INVENTION

The present inventors have made extensive study to develop a high luminance photoluminescent fiber with good mechanical properties, and the resulting fiber is believed to possess unexpected and surprising characteristics. The present invention comprises a photoluminescent fiber or plurality of fibers formed from a thermoplastic multi-component fiber comprising a pigmented and non-pigmented component wherein the pigmented component is between about 20% and 50% by weight of the multi-component fiber and the pigmented component comprises between 5% and 30% by weight of photoluminescent pigment. However, the present inventors contemplate that the pigmented component could possibly be between 5%–95% by weight of the multi-component fiber and that the pigmented component could comprise between 5%–80% by weight of luminescent pigment. The bi-component fiber has a draw ratio between and including POY (partially oriented yarn) and FDY (fully drawn yarn), and the bi-component fiber has a cross section shape selected from the group consisting of sheath/core; islands in the sea; segmented ribbon; side-by-side; segmented pie; and tipped multi-lobal cross section shapes.

Additionally, the present invention relates to a fabric that is directly melt spun (spunbonded or meltblown) from the photoluminescent fiber of the present invention.

It is therefore an object of the present invention to provide a photoluminescent fiber which possesses enhanced photoluminescence and mechanical properties that allow for subsequent processing of the fiber into a wide variety of products including athletic apparel and hunting gear, ropes and cords, life vests, carpets, airplane interiors, lingerie, and protective clothing for firefighters and chemical workers.

It is still another object of the present invention to provide for a photoluminescent fiber having enhanced photoluminescence and mechanical properties so as to provide for durability, luminescence intensity and afterglow properties without impairing the physical properties of the products from which they are manufactured.

DESCRIPTION OF THE DRAWINGS

Some of the objects of the invention having been stated other objects will become apparent with reference to the detailed description and the drawings as described hereinbelow.

DETAILED DESCRIPTION OF THE INVENTION

Figure 1:
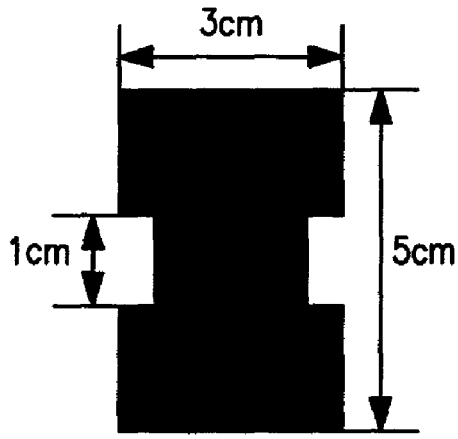
FIG. 1 is a schematic drawing of a black cardboard form used for light box testing of photoluminescence.

A number of polymers were selected and various geometries were produced in a conjugate bicomponent fiber spinning system. Mechanical properties as well as photoluminosity of the fibers were evaluated in an effort to optimize photoluminescence without sacrificing fiber mechanical properties.

I. Materials Used in Testing

A number of test samples were produced. The components containing photoluminescent pigments were prepared according to the procedures outlined in U.S. Pat. No. 5,914,076. Specifically, the pigments are compounded into the base polymer. The pigments are first ground to achieve the required uniform small distribution, and are then added and mixed with the base polymer pellets, melted, extruded, cooled and chopped into pellets.

The first sample set consisted of a series of sheath/core fibers with the photoluminescent polymer being placed in both sheath in one and in the core in another. Details are given for sample set 1 in Table 2 below.

TABLE 2

The Composition of Fiber Sample Set 1

| Sample | Core Composition | | Core/Sheath | |
|---|---|---|---|---|
| Name | Pellet % | Polymer Type | Sheath Polymer | Core %* |
| SC20 | 30% | PET | PET | 20% |
| SC30 | 30% | PET | PET | 30% |
| SC40 | 30% | PET | PET | 40% |
| SC50 | 30% | PET | PET, Nylon, PP | 50% |

*Core % is measured and calculated from images of the cross-section of the fibers A second sample set was also made to optimize the fiber mechanical properties. This set consisted of a photoluminescent core and another polymer as the sheath. This set also consisted of partially drawn yarns (POY) as well as fully drawn yarns (FDY). Details are given in Table 3 below.

TABLE 3

The Composition of Fiber Sample Set 2:

| Sample No. | Pellet % | Core | Sheath | Sheath/Core Ratio (% vol) | Denier | #Filament | Draw Ratio |
|---|---|---|---|---|---|---|---|
| 1024 | 5% | PET | 0.8IV PET | 80/20 | 985 | 175 | 3.56:1(FDY) |
| 1025 | 10% | PET | 0.8IV PET | 80/20 | 250 | 35 | POY |
| 1026 | 30% | PET | 0.8IV PET | 80/20 | 985 | 175 | 3.55:1(FDY) |
| 1026A | 30% | PET | 0.8IV PET | 80/20 | 985 | 175 | 4.16:1(FDY) |
| 1027 | 30% | PET | 0.8IV PET | 80/20 | 250 | 35 | POY |
| 1028 | 30% | Nylon6 | Nylon66 | 80/20 | 985 | 175 | 3.86:1(FDY) |
| 1029 | 30% | Nylon6 | Nylon66 | 80/20 | 250 | 35 | POY |
| 1031 | 30% | Nylon6 | Nylon66 | 80/20 | 320 | 70 | 1.62:1(FDY) |

Three nonwoven fabrics were also produced (see Table 4 below). The first two contain a single polymer loaded with 5% pigment. The third set contains two polymers (PET and NYLON) also loaded with 5% pigment. It is not necessary for both polymers to contain the pigment if one component has a higher loading of the pigment. The fibers in the third sample were formed as segmented pie to develop a splittable fiber where the fibers can be split subsequently by mechanical or thermal means to form micro fibers that are packed tightly leading to a smoother surface and potentially a higher luminance value. These fibers are split by using a hydroentangling process wherein high pressure water jets are used to impact the fibers causing splitting and also mechanically entangling the same to lead to higher mechanical performance.

Any other fiber cross section can also be formed as well. For example, the photoluminescent component can reside in the core and a regular polymer can be used to form the sheath.

The nonwoven was produced with the segmented pie configuration comprising a pigmented component wherein the pigmented component was 5%. To achieve high luminance required that both segments contain pigmented polymers. This is not necessary if one component has a pigmented component with a higher loading of the pigments. The first two samples, therefore, contain the same base polymer type. The third, however, forms a splittable fiber where the fibers can be split subsequently to form micro fibers that are packed tightly leading to a smoother surface and potentially a higher luminance value. All other fiber cross sections described above can also be formed in the spunbond and melt-blown processes.

TABLE 4

(Photoluminescent Spunbonded Fabrics)

| Sample | Description |
|---|---|
| SP-1 | PET Homocomponent |
| SP-2 | NYLON Homocomponent |
| SP-3 | PET/NYLON bicomponent Segmented Pie |

II. Materials Evaluation in Testing

The mechanical properties of single fibers as well as bundles were evaluated on a tensile testing machine.

Figure 2:
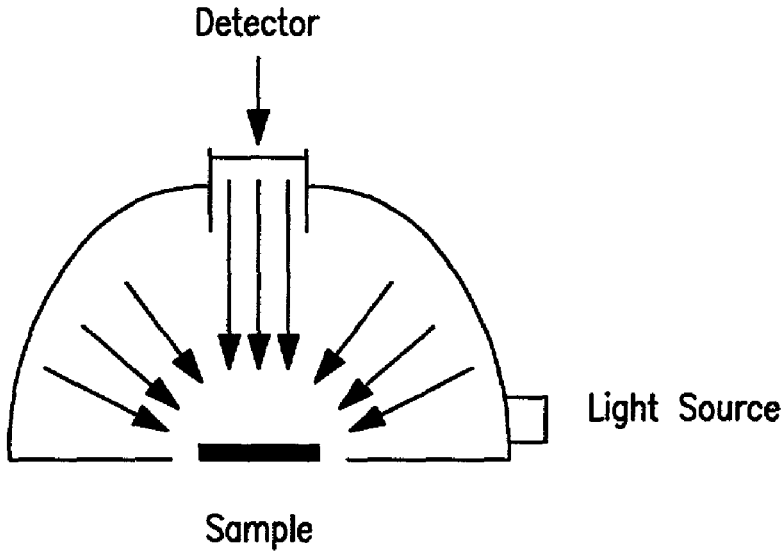
FIG. 2 is a schematic drawing of a luminance measurement system used to test the fibers of the present invention.

Photoluminescence was determined by a procedure developed in the laboratory in accordance with guidelines set out in the ASTM E2073 standard test method. A light box was developed to provide uniform illumination. The light source was a Halogen lamp adjusted to illumination of 1500 lux on the side of the sample in the integrating sphere. A light meter (Digital Light Meter available from Edmund Industrial Optics) was used to measure the illumination of the activating light source on the surface of the samples. A photodetector (Luminance Meters LS-100 available from Minolta Corp.) was used to measure photoluminescence. Measurement area of the equipment was a 1.3 mm diameter circle. The schematic of the set up is shown in FIG. 2. Fibers are uniformly wrapped around a 3×5 black cardboard as shown in FIG. 1. The density of the filaments is 5250 filaments/cm (and the cardboard is completely covered by fibers), which corresponds to approximately 250–400 μm (average 300 μm) fiber thickness.

After preconditioning in the dark room for at least a 24-hour period, the sample is excited by a light source (see FIG. 2). A computer controlled set up was developed to allow flashing the light source for a given period. Decay as a function of excitation was examined by flashing the light on for a set period, and then examining the time required for the fibers to decay back to its original level. The procedure was continued for longer excitation times until the decay time became constant. Initial luminance and decay were also measured after the samples had been excited for longer periods of time (5 minutes).

Cross sections were examined by an optical microscope after sectioning. A scanning laser confocal microscope was also used to image entire segments of the fibers and to look for cracks and any potential nonuniformity.

III. Testing Results

A. Optical and Scanning Laser Confocal Microscopy Images

Figure 3:
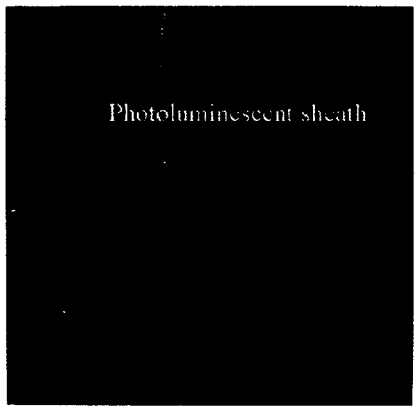
FIG. 3 is a side elevation view of a photoluminescent fiber formed with a photoluminescent sheath.
Figure 4:
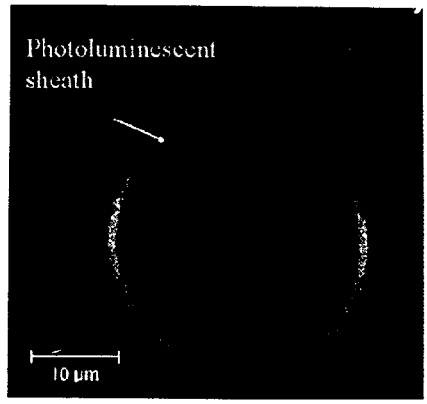
FIG. 4 is a cross sectional view of the photoluminescent fiber shown in FIG. 3.
Figure 5:
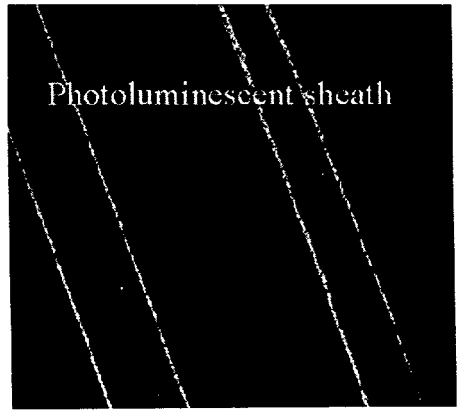
FIG. 5 is a side elevation view of the photoluminescent fiber shown in FIG. 3 wherein the sheath comprises 5% of the fiber.
Figure 6A:
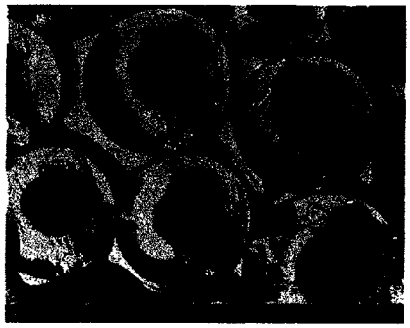
FIGS. 6(*a*)–6(*g*) show cross section views of fibers having photoluminescent pigment in the core and sheath/core ratios of 80/20 and wherein the fibers have a selected percent of photoluminescent pigment in the core (5% in FIGS. 6(*a*), 6(*b*); 10% in FIG. 6(*c*); 30% in FIGS. 6(*d*), 6(*e*), 6(*f*), 6(*g*) and 6(*h*)
Figure 6B:
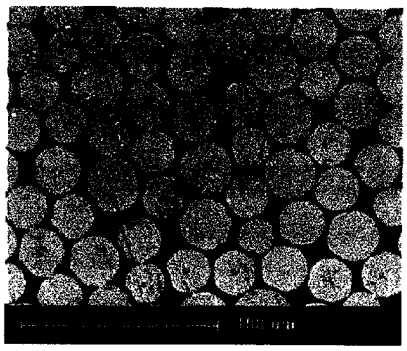
Figure 6C:
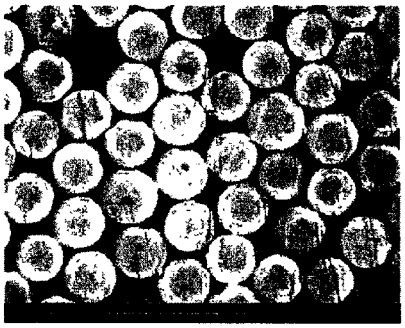
Figure 6D:
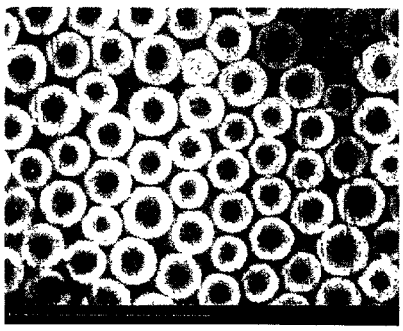
Figure 6E:
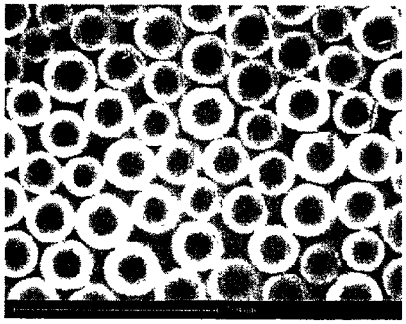
Figure 6F:
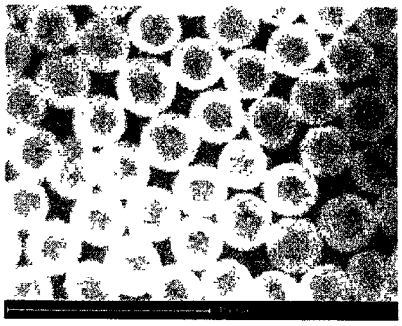
Figure 6G:
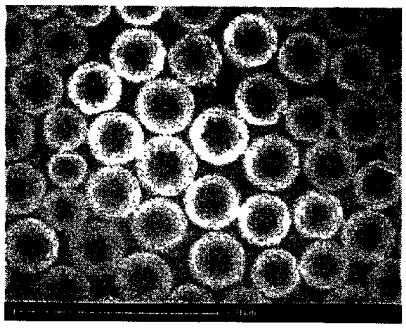
Figure 6H:
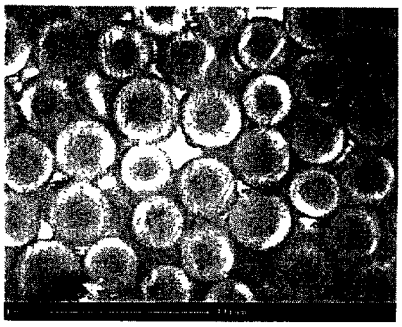

It became immediately clear that when the photoluminescent polymer is placed in the sheath, the fiber becomes brittle, is difficult to draw and the sheath will crack during the process. Furthermore, the fiber was weak and was abrasive as well. FIGS. 3 and 4 show one such example. These images were obtained by using a conventional scanning laser confocal microscope. Cracks on the fiber skin are clearly visible. Although the sheath could be reduced to as little as 5% of the fiber (see FIG. 5), the fiber properties were inadequate.

FIGS. 6(*a*)–6(*g*) shows the cross-section of all of the fibers which have photoluminescent pigment in the core and sheath/core ratio of the fibers shown are 80/20. Fibers which have low percent of photoluminescent pigment in their core (Sample 1024 (5%) and 1025 (10%)) show little distinction between core and sheath under light microscopy observation. Some particles which (could be photoluminescent pigment) are shown in the cross-sections and indicate some possible non-uniform pigment distribution in the fiber core.

Table 5 below shows measured average core % in the image and standard deviation of the core % when measured from 20 cross-sections for sample set 2.

TABLE 5

Mean and standard deviation of the core % in cross-section area

| | Sample | | | | | | |
|---|---|---|---|---|---|---|---|
| | 1024 | 1025 | 1026A | 1026 | 1027 | 1028 | 1029 |
| Mean Filament Diameter | 24.5 | 26.5 | 25.8 | 23.1 | 27.7 | 27.6 | 29.5 |
| (μm) (Standard deviation) | 3.05 | 1.78 | 2.74 | 1.83 | 1.45 | 2.90 | 2.33 |
| Core area/Fiber cross-section area (%) | — | — | 19.2 | 23.5 | 24.4 | 20.5 | 26.3 |
| (Standard deviation) | — | — | 2.46 | 2.75 | 2.50 | 2.13 | 2.96 |

B. Measurement of the Photoluminescent Decay

Figure 7:
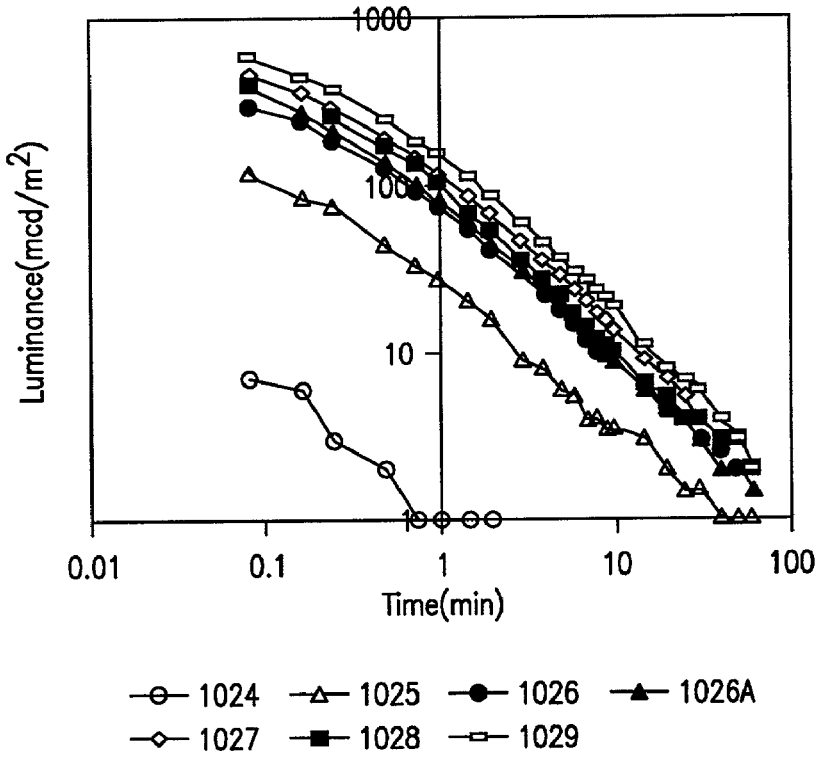
FIG. 7 is a graph of luminance decay of selected photoluminescent fibers made in accordance with the present invention.

Table 6 below and FIG. 7 show decay of luminance of the photoluminescent fibers with different fiber type and draw ratio and % pigment. From the data with the sample set 2, the effect of three parameters could be investigated. The effect of (1) the amount of photoluminescent pigment in the core component of fibers; (2) the effect of the fiber type (NYLON or PET); and (3) the draw ratio.

TABLE 6

Initial and After Glow Luminance of the Photoluminescent Fibers (Sample Set 2) after 5 Minutes Excitation With Halogen Lamp

| | After Glow (mcd/m$^2$) | | | | | | |
|---|---|---|---|---|---|---|---|
| Time | 1024 | 1025 | 1026 | 1026A | 1027 | 1028 | 1029 |
| 0 s | 63 | 289.5 | 587.5 | 725 | 851.5 | 756.5 | 995 |
| 5 s | 8 | 116 | 292 | 396 | 458 | 401.5 | 586 |
| 10 s | 8 | 83 | 239.5 | 270 | 359.5 | | 447 |
| 15 s | 3 | 73 | 187 | 211 | 291 | 254 | 376 |
| 30 s | 1.5 | 44 | 124.5 | 138 | 192 | 173 | 252 |
| 45 s | 1 | 33 | 90.5 | 100 | 145.5 | 134 | 186 |
| 1 min | 1 | 27 | 73.5 | 80 | 117.5 | 105 | 155 |
| 1 min 30 s | | 20 | 53.5 | 57 | 85 | 66 | 112 |
| 2 min | | 15.5 | 41 | 44.5 | 66.5 | 53 | 86 |
| 3 min | | 9 | 30.5 | 30.5 | 45.5 | 35.5 | 59 |
| 4 min | | 8 | 22 | 23.5 | 35 | 27 | 45 |
| 5 min | | 6 | 17.5 | 18.5 | 29 | 22 | 36 |
| 6 min | | 5.5 | 14.5 | 15.5 | 23.5 | 17 | 30 |
| 7 min | | 4 | 12 | 12 | 20.5 | 14 | 27 |
| 8 min | | 4 | 10 | 10.5 | 17 | 12 | 23 |
| 9 min | | 3.5 | 9.5 | 9.5 | 15.5 | 11 | 21 |
| 10 min | | 3.5 | 9 | 9 | 13.5 | 10 | 19 |
| 15 min | | 3 | 6.5 | 6 | 9 | 6.5 | 11 |
| 20 min | | 2 | 4.5 | 4.5 | 7 | 5.5 | 8 |
| 25 min | | 1.5 | 4 | 4 | 5.5 | 4 | 7 |
| 30 min | | 1.5 | 3 | 3 | 4 | 4 | 6 |
| 40 min | | 1 | 2.5 | 2 | 3 | 3 | 4 |
| 50 min | | 1 | 2 | 2 | 2 | 3 | 3 |
| 60 min | | 1 | 2 | 1.5 | 2 | 2 | 2 |

Among those parameters, only the amount of photoluminescent pigment appears to have significant effect on the initial luminance and its decay. NYLON and PET show almost the same behavior when pellet % and sheath/core ratio is constant. POY tends to show a little higher luminance than FDY. However, this may not be caused by real luminance intensity but by the amount of filaments that exist in the measurement area. Since filament sizes of POY tend to be larger than that of FDY, the same number of filaments of POY makes thicker filament area (as shown in Table 7 below), so it has more luminance material than that of FDY at the same condition.

TABLE 7

Calculated Thickness of the Fiber bundle Layer

| | Sample | | | | | | |
|---|---|---|---|---|---|---|---|
| | 1024 | 1025 | 1026 | 1026A | 1027 | 1028 | 1029 |
| Thickness μm | 275 | 322 | 306 | 246 | 350 | 349 | 399 |

Figure 8A:
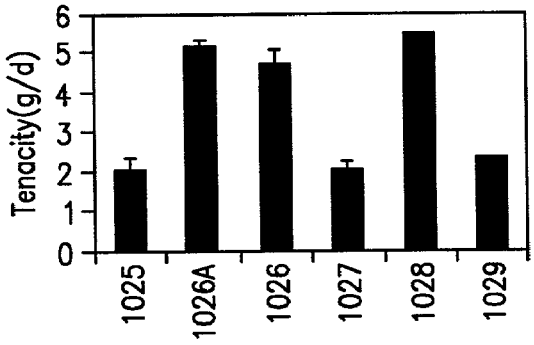
FIGS. 8(*a*) and 8(*b*) are graphs showing the mechanical properties of tenacity and elongation, respectively, for selected fibers made in accordance with the present invention.
Figure 8B:
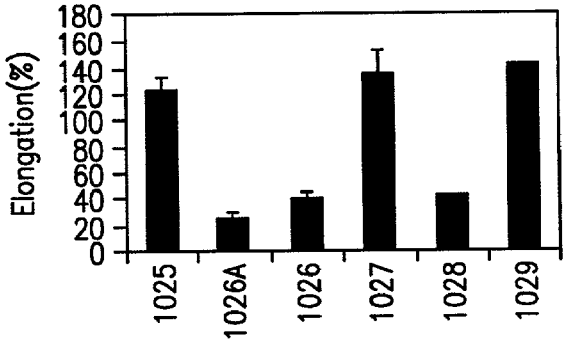
Figure 9:
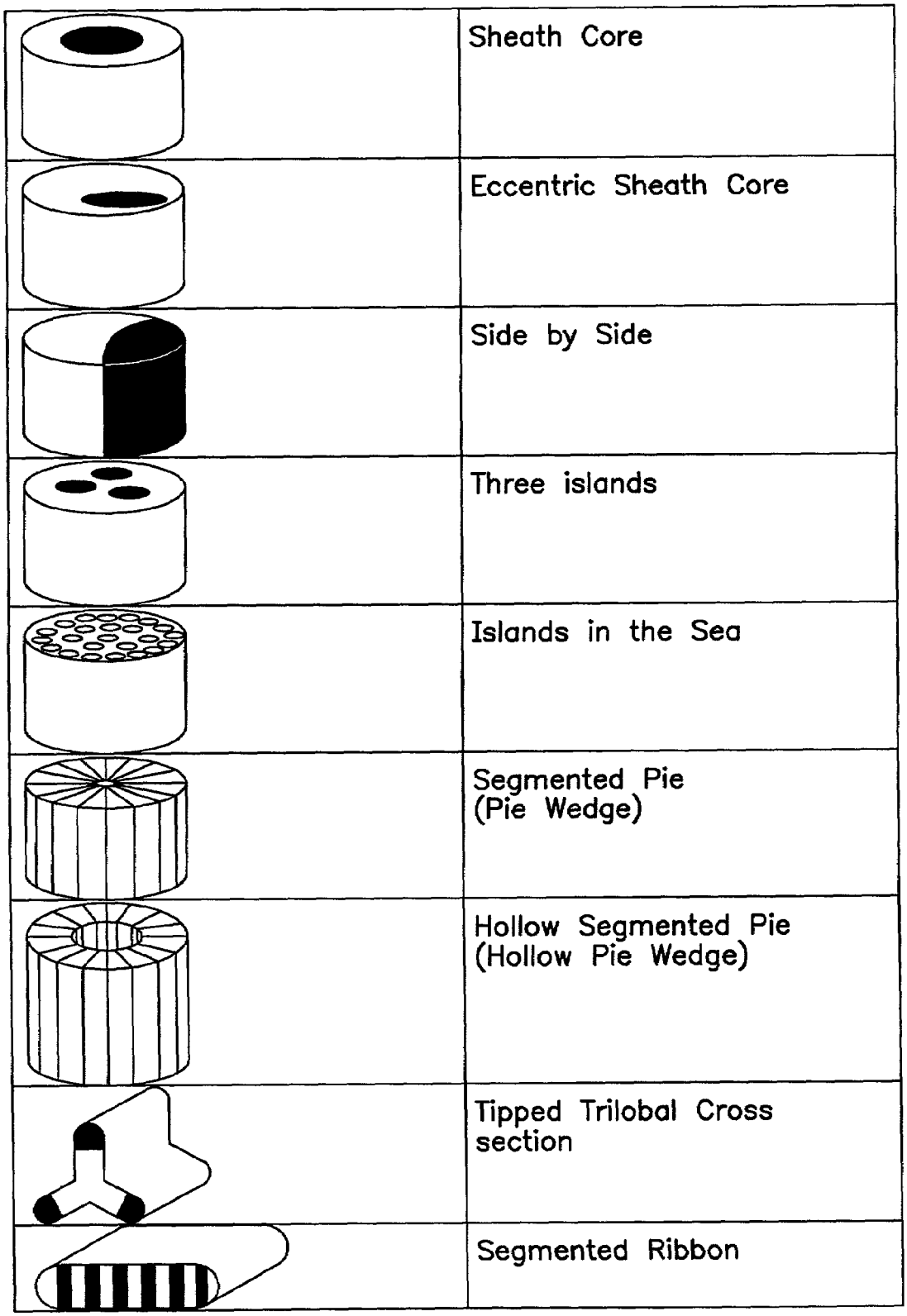
FIG. 9 is a view of different cross section shapes which can be formed from the photoluminescent fiber made in accordance with the present invention including sheath/core; eccentric sheath core; side-by-side; three islands; islands in the sea; segmented pie; hollow segmented pie; tipped trilobal cross section; and segmented ribbon.

Drawn fibers show good mechanical properties for both PET and NYLON sheath. Specifically, FIGS. 8(*a*) and 8(*b*) show graphs of the mechanical properties of tenacity and elongation, respectively, for sample set 2 fibers.

FIG. 10 shows the fiber cross sections achieved in a spunbond process in both sheath/core as well as segmented pie configurations. These fibers were equal to those made by fiber spinning.

IV. The Invention

Thus, the invention discovered is a photoluminescent fiber with higher luminance and better mechanical properties than have been achieved heretofore. The fiber is a thermoplastic multi-component fiber, preferably NYLON or polyester, having a pigmented and non-pigmented component wherein the pigmented component is preferably inside the fiber. The pigmented component is preferably between about 20%–50% by weight of the multi-component fiber and the pigmented component preferably comprises between about 5%–30% by weight of luminescent pigment. However, applicants contemplate that the pigmented component could be between 5%–95% by weight of the multi-component fiber and that the pigmented component could comprise between 5%–80% by weight of luminescent pigment. The multi-component fiber has a draw ratio including POY and FDY, and the multi-component fiber has a cross section shape selected from the group consisting of sheath/core, islands in the sea, segmented ribbon, side-by-side, segmented pie, and multi-lobal shapes.

Further, the invention contemplates that the novel multi-component photoluminescent fiber may include another embodiment.

In this embodiment, other particles or pigments may be used instead of or together with the photoluminescent particles. That is, the same process may be used to incorporate other metals, metal oxides, organic and inorganic particles, magnetic particles, clays, activated carbon particles, carbon nanotubes, ceramics, glass and other such solid particles into the fiber to impart additional functionality. Therefore, additional functionality or multiple functionality is achieved by the use of multi-component fiber spinning system. For example, one component may contain or carbon nanotubes for conductivity and the other may have photoluminescent particles for luminescence.

Finally, the present invention contemplates a process for making the photoluminescent fibers of the invention into photoluminescent fabrics. An inexpensive and novel method for developing photoluminescent fabrics is contemplated wherein the fabrics can be made from the photoluminescent fibers in nonwoven processes such as carding, air lay, wet lay, and then bonded mechanically, chemically, thermally, or by combination of these bonding technologies or by using weaving, knitting or braiding technologies. Alternatively, the photoluminescent fabrics can be made directly from spunbonding and/or melt-blowing to achieve a nonwoven photoluminescent fabric directly from the photoluminescent fibers. It is contemplated that various cross sections of the fiber may be used and splittable by component fibers will lead to a very dense, flat and smooth suede-like material with high photoluminescence.

Figure 10A:
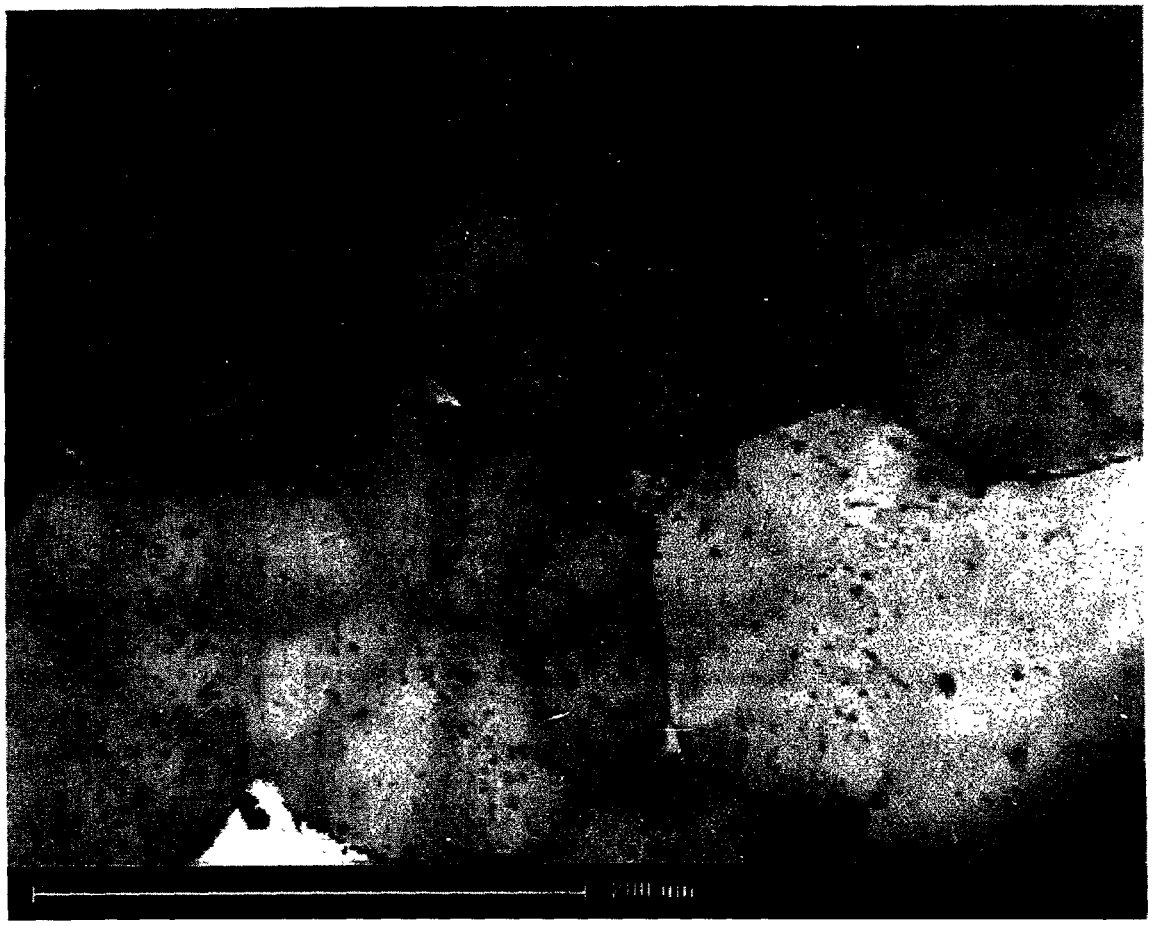
FIG. 10A–10B is a view of segmented pie cross section fibers in a spunbonded nonwoven fabric.
Figure 10B:
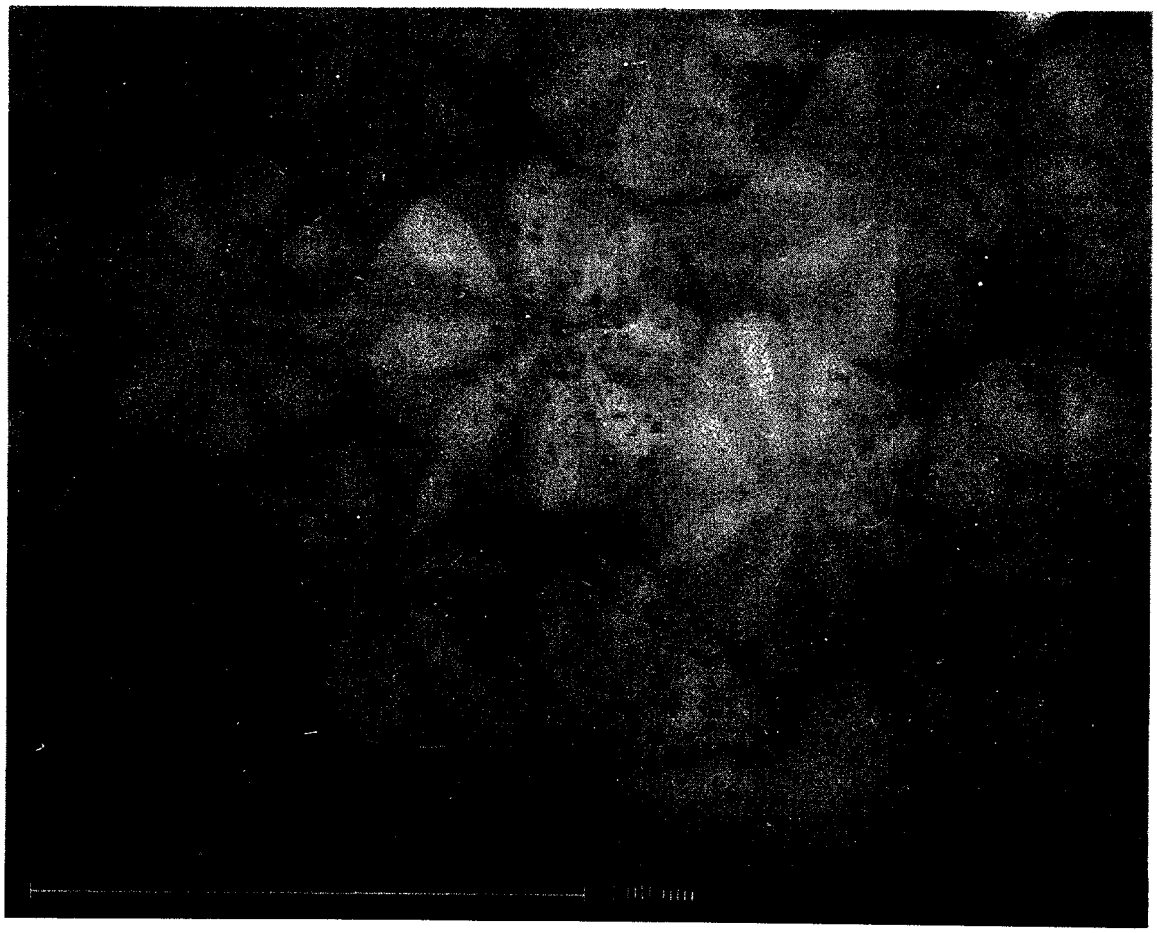

The construction of a representative nonwoven fabric made in accordance with the invention is described hereinafter. Test sample nonwovens were produced by applicants with a bicomponent segmented pie fiber configuration comprising NYLON/polyester. The nonwoven fabric fiber cross sections are shown in FIGS. 10A–10B.

It will be understood that various details of the invention may be changed without departing from the scope of the invention. Furthermore, the foregoing description is for the purpose of illustration only, and not for the purpose of limitation—the invention being defined by the claims.

What is claimed is:

1. A spunbonded photoluminescent nonwoven fabric comprising photoluminescent thermoplastic fibers wherein each fiber comprises pigmented and non-pigmented components wherein the components can be the same or different fibers and the pigmented component is between about 5%–20% by weight of the multi-component fiber and the pigmented component comprises between about 5%–30% by weight of photoluminescent pigment, and wherein the fiber has a draw ratio including both POY and FDY, and wherein the FDY fiber has tensile strength of about 4–5 g/denier or greater and about 20%–40% strain failure, and wherein the fiber has a luminance of at least about 50 $mcd/m^2$ at 1 minute after 5 minutes of excitation, and said fiber has a cross section shape selected from the group consisting of sheath/core; islands in the sea; segmented ribbon; side-by-side; segmented pie; and tipped multi-lobal shapes.

* * * * *